US006544087B1

(12) United States Patent
Peng

(10) Patent No.: US 6,544,087 B1
(45) Date of Patent: Apr. 8, 2003

(54) ADJUSTABLE FIXING STRUCTURE OF PADDLE FOR ADJUSTING LENGTH OF PADDLE

(76) Inventor: I-Sin Peng, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/158,447

(22) Filed: May 31, 2002

(51) Int. Cl.[7] ..... B63H 16/04
(52) U.S. Cl. ..... 440/101
(58) Field of Search ..... 440/101; 416/70 R, 416/69

(56) References Cited

U.S. PATENT DOCUMENTS 4,820,216 A * 4/1989 Masters ..... 440/101
6,022,255 A * 2/2000 Lukanovich ..... 440/101

* cited by examiner

*Primary Examiner*—Ed Swinehart

(57) ABSTRACT

An adjustable fixing structure of a paddle for adjusting a length of the paddle has an outer tube, an inner tube and a tightening device. The tightening device is formed by a positioning ring at the outer tube and an engaging portion at the inner tube. The positioning ring is protruded with an eccentric buckle, and the buckle is protruded with an elastomer. The eccentric buckle of the positioning ring is inserted into a through hole of the engaging portion. The elastomer of the positioning ring is exactly inserted into an eccentric embedded hole in the through hole. Thereby, when the engaging portion rotates, the engaging portion will separate from a center of the positioning ring gradually due to eccentricity. As a result, the engaging portion will apply a force to the positioning ring; and thus, the outer tube and inner tube are tightly coupled with one another.

2 Claims, 5 Drawing Sheets

FIG1-A
PRIOR ART

FIG1-B
PRIOR ART

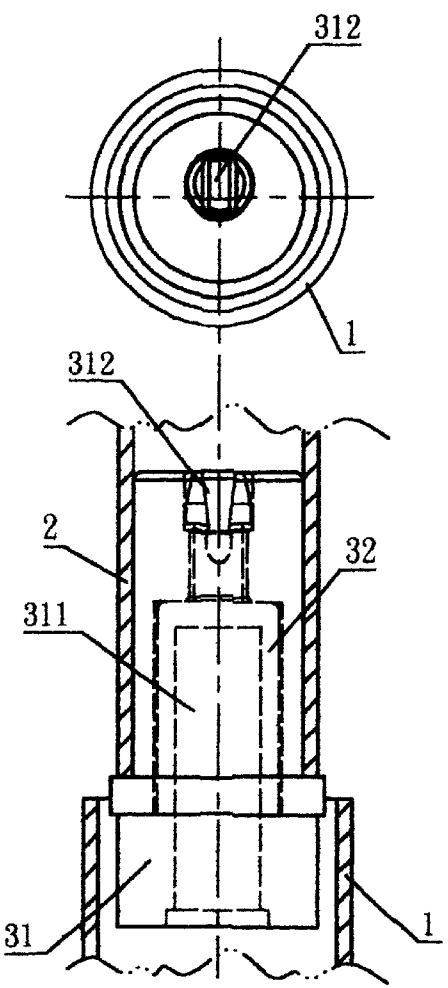
FIG5-B
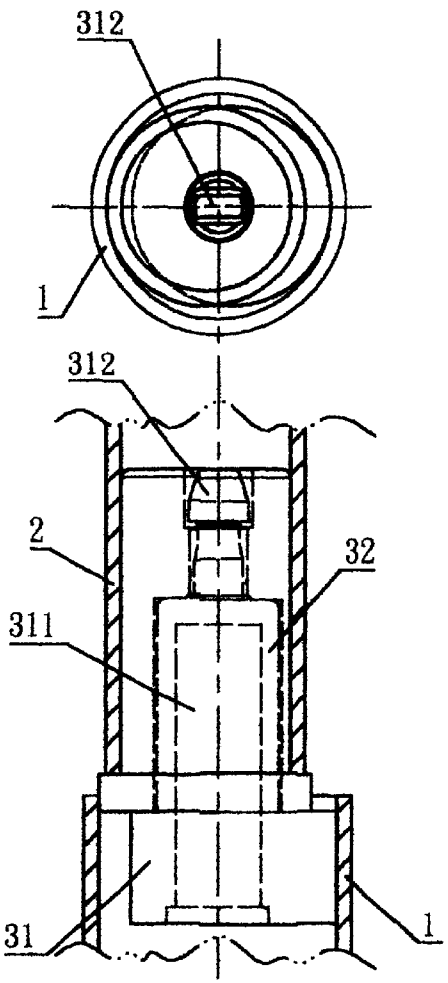
FIG5-A

ADJUSTABLE FIXING STRUCTURE OF PADDLE FOR ADJUSTING LENGTH OF PADDLE

FIELD OF THE INVENTION

The present invention relates to adjustable fixing structures, and particularly to an adjustable fixing structure of a paddle for adjusting the length of the paddle, wherein an eccentric structure is used to a buckle of a positioning ring in an outer tube and to an embedded hole of a engaging portion in the inner tube so that the outer tube and inner tube of the paddle can be tightly engaged.

BACKGROUND OF THE INVENTION

A prior art telescopic tube used in a paddle is illustrated in FIG. 1. A hidden inner rod 5 has a head which is firmly secured to an eccentric head 51. A C shape block 53 is installed to one eccentric portion 52. The outer tube 6 has a head which is firmly secured to a short plug tube 61. When the hidden inner rod 5 having the eccentric head 51 is inserted into the outer tube 6, the outer tube 6 can rotate with respect to the hidden inner rod 5 (referring to FIG. 1A) so that the diameter of the C shape block 53 will expand by the eccentric section 52 to tighten the inner wall of the outer tube 6. Thus the outer tube 6 and the inner rod 5 are fixed to one another.

However, the prior art C shape block 53 is not so good to meet the user's need. Although the outer tube 6 is engaged with the inner rod 5, if the inner rod 5 is ejected, it will easily further enter into the outer tube 6 so as to lose the fixedness of the inner rod 5 and the outer tube 6.

SUMMARY OF THE INVENTION

Accordingly, the primary object of the present invention is to provide an adjustable fixing structure of a paddle for adjusting the length of the paddle so as to improve the defects in the prior art.

To achieve above objects, the present invention provides an adjustable fixing structure of a paddle for adjusting the length of the paddle. The paddle has an outer tube, an inner tube and a tightening means for tightening the outer tube and inner tube. The tightening means is formed by a positioning ring at one end portion of the outer tube and an engaging portion at one end portion of the inner tube. The positioning ring is buckled to the engaging portion. One end portion of the positioning ring is protruded with an eccentric buckle, and one end of the buckle is protruded with an elastomer. An interior of the engaging portion has a stepped through hole. One small end of the through hole has an eccentric embedded hole. The eccentric buckle of the positioning ring is inserted into the through hole of the engaging portion. The elastomer of the positioning ring is exactly inserted into the eccentric embedded hole of the engaging portion. Thereby, when the engaging portion rotates, the engaging portion will separate from a center of the positioning ring gradually due to eccentricity so that a center of the engaging portion will not align with a center of the positioning ring. As a result, a lateral side of the engaging portion will apply a force to a lateral side of the positioning ring; and thus, the outer tube and inner tube are tightly coupled with one another.

The various objects and advantages of the present invention will be more readily understood from the following detailed description when read in conjunction with the appended drawing.

BRIEF DECEPTION OF THE DRAWINGS

FIG. 1A is a partial schematic view showing the engagement of the prior art structure.

FIG. 1B is a partial schematic view showing the releasing operation in the prior art.

FIG. 5A is a partial schematic view showing the tightening operation of the present invention.

FIG. 5B is a partial schematic view showing the releasing operation of the present invention.

DETAILED DESCRIPTION OF THE PREFERRED EMBODIMENTS

Figure 1:
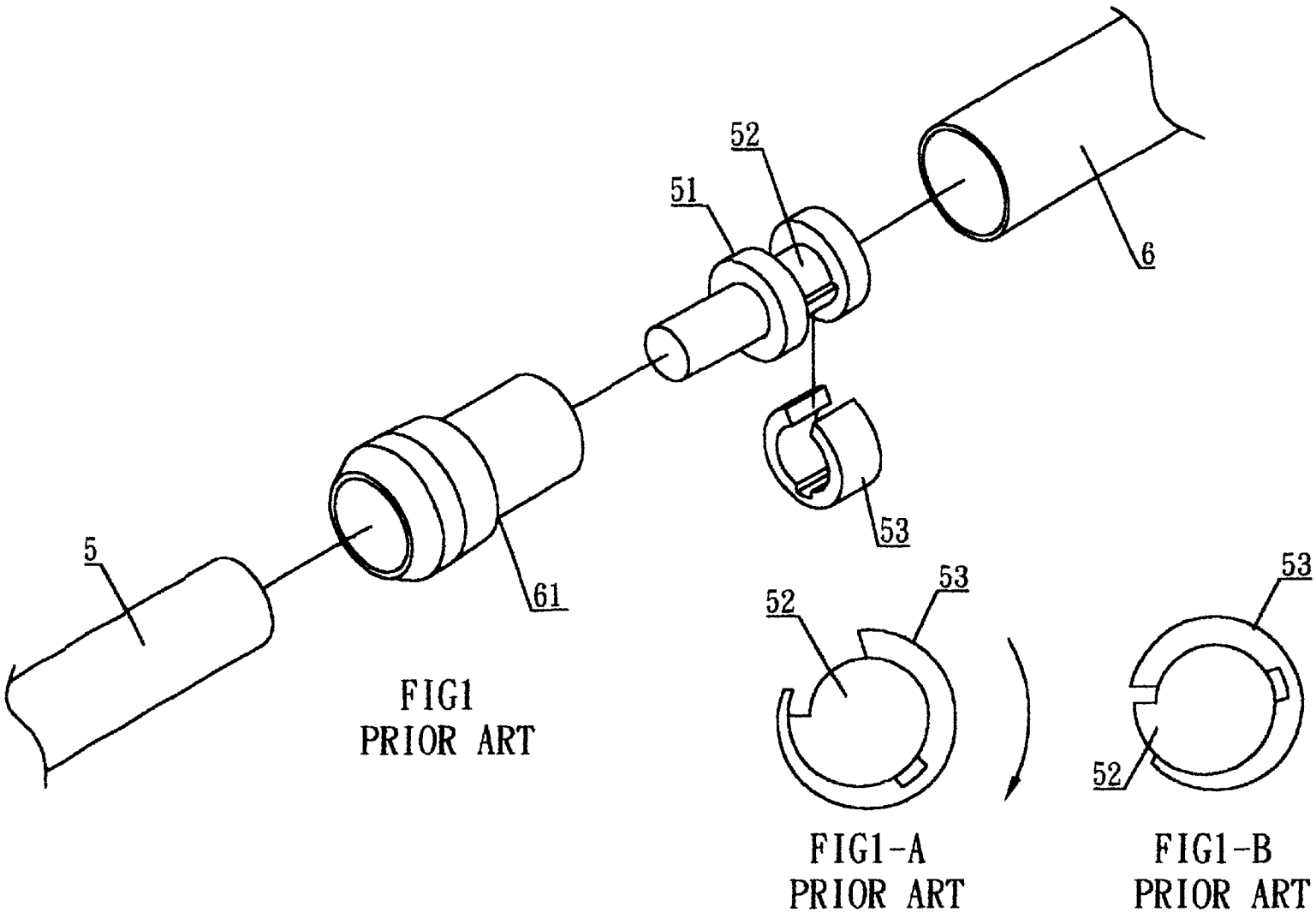
FIG1 PRIOR ART
FIG. 1 is an exploded perspective view of a prior art.
Figure 2:
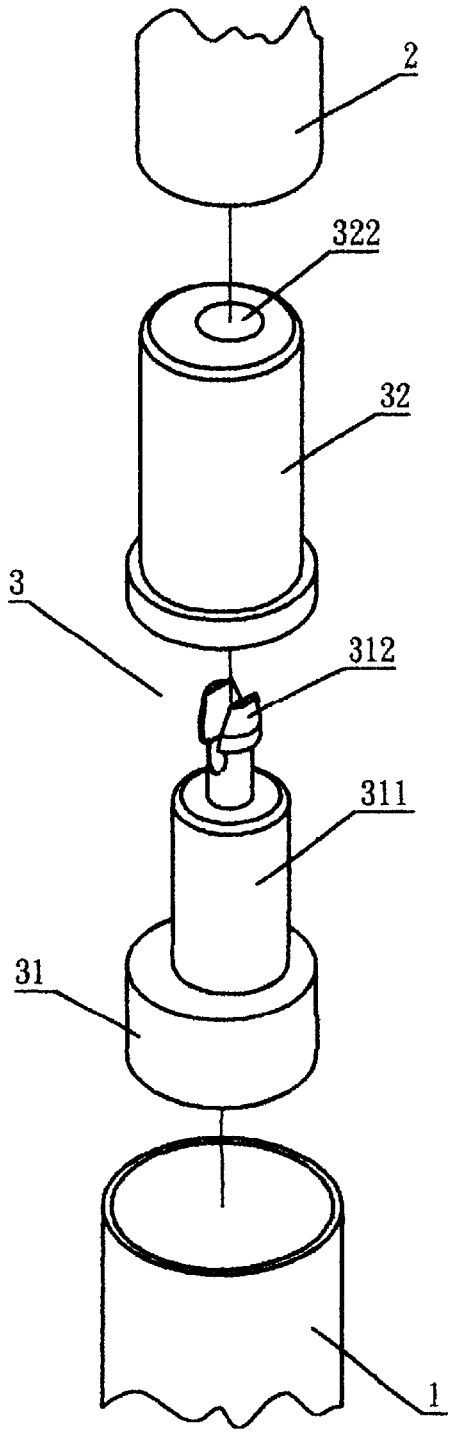
FIG. 2 is an exploded perspective view of the present invention.
Figure 4:
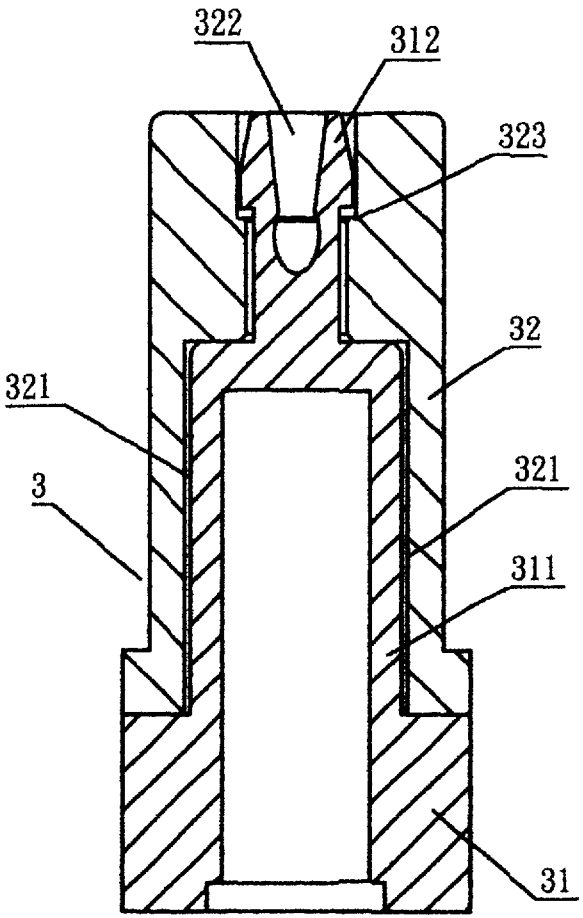
FIG. 4 is a plane cross sectional view of the present invention.
Figure 3:
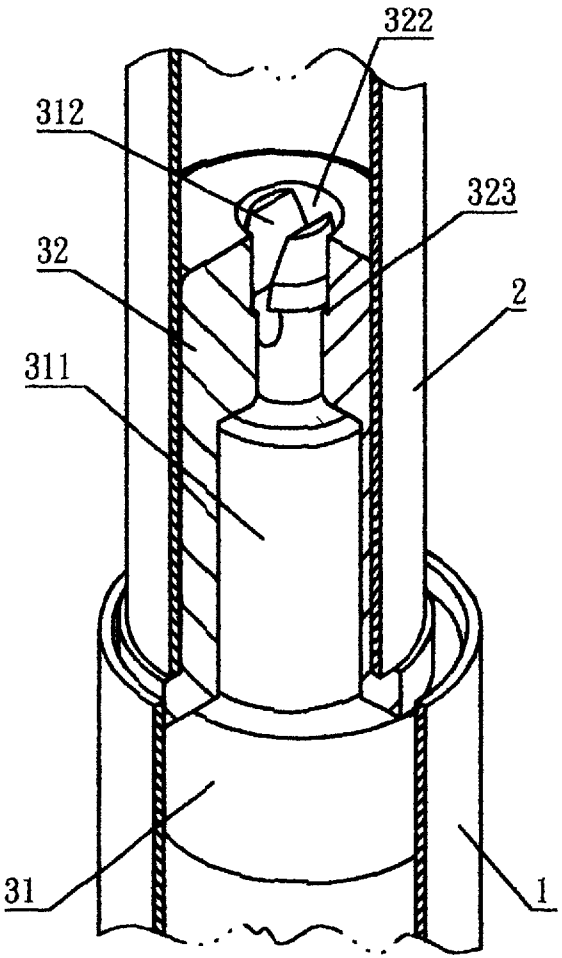
FIG. 3 is a cross sectional view of the present invention.

With reference to FIGS. 2 to 4, the structure of the present invention is clearly shown. The present invention has an outer tube 1, an inner tube 2 and a tightening means 3 for tightening the outer tube 1 and outer tube 2.

The tightening means 3 is formed by a positioning ring 31 at one end portion of the outer tube 1 and an engaging portion 32 at one end portion of the inner tube 2. The positioning ring 31 is buckled to the engaging portion 32.

One end portion of the positioning ring 31 is protruded with an eccentric buckle 311, and one end of the buckle 311 is protruded with an elastomer 312. The elastomer 312 can be pushed and pulled so that the elastomer 312 can be engaged in an eccentric embedded hole 322 of the engaging portion 32.

An interior of the engaging portion 32 has a stepped through hole 321. One small end of the through hole 321 is the eccentric embedded hole 322 and the inner side of the embedded hole 322 has an edge 323 for resisting against the elastomer 312 of the positioning ring 31.

The eccentric buckle 311 of the positioning ring 31 is inserted into the through hole 321 of the engaging portion 32. The elastomer 312 of the positioning ring 31 is exactly inserted into the eccentric embedded hole 322 of the engaging portion 32. Thereby, when the engaging portion 32 rotates, the engaging portion 32 will separate from a center of the positioning ring 31 gradually due to eccentricity so that a center of the engaging portion 32 will not align with a center of the positioning ring 31, thereby, the lateral side of the engaging portion 32 will apply a force to the lateral side of the positioning ring 31 Thus, the outer tube 1 and inner tube 2 are tightly coupled with one another.

The assembly of the present invention will be described, with reference to FIGS. 4 and 5, the positioning ring 31 is firstly firmly secured to one end portion of the outer tube 1. The engaging portion 32 is firmly secured to one end portion of the inner tube 2 in advance. Then the buckle 311 of the positioning ring 31 is inserted into the through hole 321 of the engaging portion 32 so that the elastomer 312 of the buckle 311 will be engaged with the embedded hole 322, by the effect of the elastomer 312, it can be engaged to the embedded hole 322 of the engaging portion 32. Thereby, the elastomer 312 resists against the stepped edge 323 of the through hole 321 (referring to FIG. 4).

When the elastomer 312 of the positioning ring 31 is embedded into the embedded hole 322, a space is formed between the outer tube 1 and inner tube 2 for being inserted by the inner tube 2. Thereby, the outer tube 1 and the inner tube 2 are loosed. Then, the outer tube 1 and inner tube 2 are rotated through an angle so that the engaging portion 32 and positioning ring 31 fixed to the inner tube 2 and outer tube 1 are rotated. Since the buckle 311 of the elastomer 312 and the embedded hole 322 of the engaging portion 32 are eccentric, the center of the engaging portion 32 and the center of the positioning ring 31 will separate from one another. Thereby, a part of the edge of the engaging portion 32 will push one edge of the positioning ring 31 so that the inner tube 2 will resist against the inner wall of the outer tube 1. Therefore, the two tubes are tightly positioned (referring to FIG. 5A)

Figure 6:
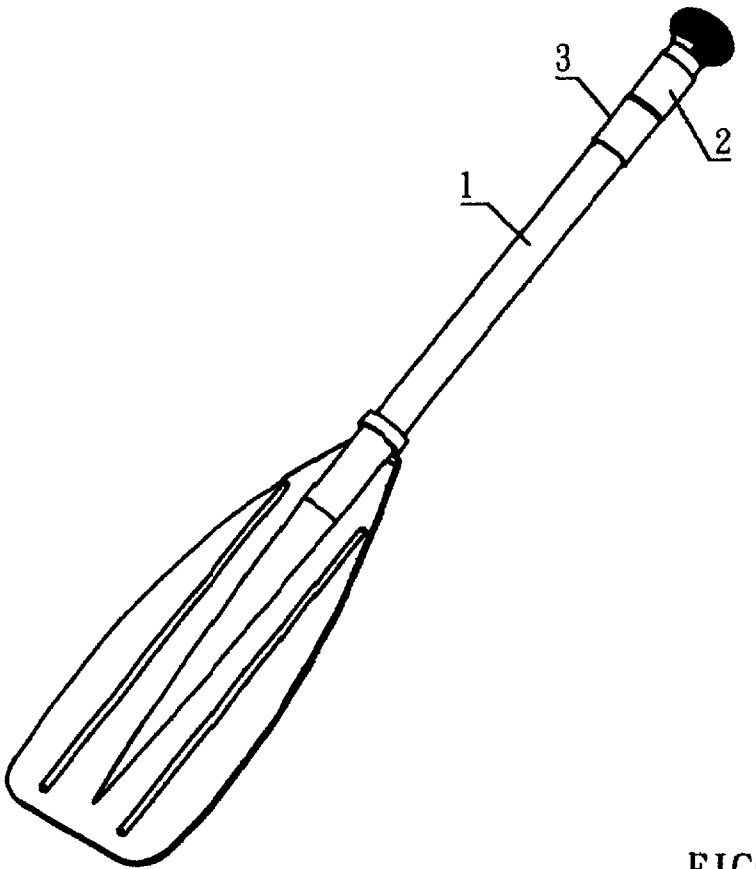
FIG. 6 shows that the structure of the present invention is applied to a paddle.

When it is desired to adjust the length of the paddle, the outer tube 1 can be rotated with respect to the inner tube 2 along an opposite direction so that the centers of the engaging portion 32 and the positioning ring 31 are aligned. Then the end edge of the engaging portion 32 is exactly coupled to the end edge of the positioning ring 31 so that the engaging portion 32 is loosely engaged to the positioning ring 31 (referring to FIG. 5B). Then the lengths of the outer tube 1 and inner tube 2 can be adjusted. Then the outer tube 1 and inner tube 2 are rotated again for positioning. Since the elastomer 312 of the positioning ring 31 is engaged to the stepped edge of the embedded hole 322 of the engaging portion 32, the outer tube 1 will not separate from the inner tube 2 under any condition. The tightening means 3 has the effect of preventing the inner tube 2 from compression. FIG. 6 shows that the structure of the present invention is applied to a paddle.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable fixing structure of a paddle for adjusting a length of the paddle, said paddle having an outer tube, an inner tube and a tightening means for tightening the outer tube and inner tube, wherein the tightening means is formed by a positioning ring at one end portion of the outer tube and an engaging portion at one end portion of the inner tube; the positioning ring is buckled to the engaging portion;

one end portion of the positioning ring is protruded with an eccentric buckle, and one end of the buckle is protruded with an elastomer;

an interior of the engaging portion has a stepped through hole; one small end of the through hole has an eccentric embedded hole and an inner side of the embedded hole has an edge for resisting against the elastomer of the positioning ring;

wherein the eccentric buckle of the positioning ring is inserted into the through hole of the engaging portion; the elastomer of the positioning ring is exactly inserted into the eccentric embedded hole of the engaging portion; thereby, when the engaging portion rotates, the engaging portion will separate from a center of the positioning ring gradually due to eccentricity so that a center of the engaging portion will not align with a center of the positioning ring, thereby, a lateral side of the engaging portion will apply a force to a lateral side of the positioning ring; thus, the outer tube and inner tube are tightly coupled with one another.

2. The adjustable fixing structure of a paddle as claimed in claim 1, wherein the elastomer of the positioning ring is pushable and pullable so that the elastomer is capable of being inserted into the embedded hole of the engaging portion.

* * * * *